US008048367B2

(12) United States Patent
Hoshino et al.

(10) Patent No.: US 8,048,367 B2
(45) Date of Patent: Nov. 1, 2011

(54) HIGH STRENGTH THICK-GAUGE STEEL PLATE SUPERIOR IN WELDABILITY AND HAVING TENSILE STRENGTH OF 780 MPA OR MORE AND METHOD OF PRODUCTION OF SAME

(75) Inventors: Manabu Hoshino, Tokyo (JP); Masaaki Fujioka, Tokyo (JP); Youichi Tanaka, Tokyo (JP); Masanori Minagawa, Tokyo (JP)

(73) Assignee: Nippon Steel Corporation, Tokyo (JP)

( * ) Notice: Subject to any disclaimer, the term of this patent is extended or adjusted under 35 U.S.C. 154(b) by 0 days.

(21) Appl. No.: 12/867,731

(22) PCT Filed: Oct. 22, 2009

(86) PCT No.: PCT/JP2009/068546

§ 371 (c)(1),
(2), (4) Date: Aug. 13, 2010

(87) PCT Pub. No.: WO2010/047416

PCT Pub. Date: Apr. 29, 2010

(65) Prior Publication Data

US 2011/0041965 A1 Feb. 24, 2011

(30) Foreign Application Priority Data

Oct. 23, 2008 (JP) ..... 2008-273097

(51) Int. Cl.

| | |
|---|---|
| ***C22C 38/04*** | (2006.01) |
| ***C22C 38/00*** | (2006.01) |
| ***C21D 8/02*** | (2006.01) |
| ***C21D 8/00*** | (2006.01) |

(52) U.S. Cl. ..... 420/120; 420/121; 420/128; 148/330; 148/337; 148/579; 148/645; 148/648

(58) Field of Classification Search ..... 148/330, 148/337, 579, 645, 648; 420/120, 121, 128
See application file for complete search history.

(56) References Cited

U.S. PATENT DOCUMENTS

2004/0031544 A1* 2/2004 Hara et al. ..... 148/521

FOREIGN PATENT DOCUMENTS

| | | | |
|---|---|---|---|
| JP | 3-232923 | A | 10/1991 |
| JP | 8-188823 | A | 7/1996 |
| JP | 9-263828 | A | 10/1997 |
| JP | 2000-160281 | A | 6/2000 |
| JP | 2000-319726 | A | 11/2000 |
| JP | 2001-226740 | A | 8/2001 |
| JP | 2004-52063 | A | 2/2004 |
| JP | 2004-52104 | A | 2/2004 |
| JP | 2005-15859 | A | 1/2005 |
| JP | 2005-307312 | A | 11/2005 |
| JP | 2006-131958 | A | 5/2006 |
| JP | 2006-283117 | A | 10/2006 |
| JP | 2007-262477 | A | 10/2007 |
| JP | 2007-277622 | A | 10/2007 |
| JP | 2007-277623 | A | 10/2007 |
| JP | 2007-302974 | A | 11/2007 |
| KR | 10-2003-0091792 | A | 12/2003 |
| KR | 10-0712794 | B1 | 4/2007 |

OTHER PUBLICATIONS

Notice of Allowance on Taiwanese Application No. 98135769 issued on Dec. 17, 2010.
International Search Report, dated Feb. 2, 2010 and issued in PCT/JP2009/068546.
Korean Office Action dated May 20, 2011 in Korean Patent Application Publication No. 10- 2010-7019221.

* cited by examiner

*Primary Examiner* — Roy King
*Assistant Examiner* — Caitlin Fogarty
(74) *Attorney, Agent, or Firm* — Birch, Stewart, Kolasch & Birch, LLP

(57) ABSTRACT

The present invention provides high strength thick-gauge steel plate superior in weldability and having a tensile strength of 780 MPa or more and provides a method of production of the high strength thick-gauge steel plate by omitting tempering heat treatment in the production. The high strength thick-gauge steel plate of the present invention is high strength thick-gauge steel plate containing, by mass %, C: 0.030 to 0.055%, Mn: 2.4 to 3.5%, P: 0.01% or less, S: 0.0010% or less, Al: 0.06 to 0.10%, B: 0.0005 to 0.0020%, and N: 0.0015 to 0.0060%, having a weld cracking susceptibility parameter Pcm of 0.18% to 0.24%, and comprised mainly of martensite. The method of production of high strength thick-gauge steel plate of the present invention comprises heating a steel slab or cast slab having a predetermined composition of ingredients to 950 to 1100° C., rolling it at 820° C. or more, then starting accelerated cooling from 700° C. or more by a cooling rate of 8 to 80° C./sec and stopping the accelerated cooling at room temperature to 350° C.

10 Claims, No Drawings

HIGH STRENGTH THICK-GAUGE STEEL PLATE SUPERIOR IN WELDABILITY AND HAVING TENSILE STRENGTH OF 780 MPA OR MORE AND METHOD OF PRODUCTION OF SAME

TECHNICAL FIELD

The present invention relates to preheat-free high strength thick-gauge steel plate superior in weldability and having a tensile strength of 780 MPa or more and a method of producing the same with a high productivity and by a low cost.

The invention steel is suitably used as a structural member of construction machines, industrial machinery, bridges, buildings, ships, and other welded structures in the form of thick-gauge steel plate of a plate thickness of 12 mm to 40 mm.

Note that here, "preheat-free" means the state where when using shielded arc, TIG, MIG, or other welding at room temperature for welding by a 2 kJ/mm or less heat input in a JIS Z 3158 "y-groove weld cracking test", the preheating temperature required for preventing weld cracking is 25° C. or less or preheating is not required at all.

BACKGROUND ART

The high strength steel plate of a tensile strength of 780 MPa or more used as members for construction machines, industrial machinery, bridges, buildings, ships, and other welded structures is now being required to provide both high strength and high toughness of the base material, satisfy the requirements of high weldability by a preheat-free process, and be able to be produced inexpensively in a short time in plate thicknesses of 40 mm or so. That is, it is necessary to satisfy the requirements of high strength and high toughness of the base material and a preheat-free process at the time of shielded arc, TIG, and MIG welding or other small heat input welding by an inexpensive system of ingredients, a short work time, and an inexpensive production process.

As the conventional method of production of high strength thick-gauge steel plate of a tensile strength of 780 MPa or more giving high weldability, for example, as disclosed in PLTs 1 to 3, there is the method of rolling the steel plate, then immediately directly quenching it on-line, then tempering it, that is, using direct quenching and tempering.

Further, for a non-heat treatment type of method of production of high strength thick-gauge steel plate of a tensile strength of 780 MPa or more not requiring reheat tempering heat treatment after rolling, for example, there are the disclosures in PLTs 4 to 8. Each is a method of production superior in production period and productivity in the point that the reheat tempering heat treatment can be omitted. Among these, the inventions described in PLTs 4 to 7 relate to a method of production by an accelerated cooling-interim stop process comprising rolling steel plate, then accelerated cooling it, then stopping midway. Further, the invention described in PLT 8 relates to a method of production of rolling, then air cooling down to room temperature.

Citation List

Patent Literature

PLT 1: Japanese Patent Publication (A) No. 03-232923
PLT 2: Japanese Patent Publication (A) No. 09-263828
PLT 3: Japanese Patent Publication (A) No. 2000-160281
PLT 4: Japanese Patent Publication (A) No. 2000-319726
PLT 5: Japanese Patent Publication (A) No. 2005
PLT 6: Japanese Patent Publication (A) No. 2004-52063

PLT 7: Japanese Patent Publication (A) No. 2001-226740
PLT 8: Japanese Patent Publication (A) No. 08-188823

SUMMARY OF INVENTION

Technical Problem

However, for example, in the inventions described in PLTs 1 to 3, reheat tempering heat treatment becomes necessary, so there are problems in production period, productivity, and production costs. Against such prior art, there are strong demands for a so-called non-heat treatment method of production enabling reheat tempering heat treatment to be omitted.

As a non-heat treatment method of production, in the invention described in PLT 4, as described in the examples, preheating at 50° C. or more is necessary at the time of welding and therefore there is the problem that the requirement of preheat-free high weldability cannot be satisfied. Furthermore, in the invention described in PLT 5, 0.6% or more of Ni has to be added, so the system of ingredients becomes expensive and there is a problem in production costs. In the invention described in PLT 6, it is only possible to produce up to the plate thickness 15 mm described in the examples. The requirement for a plate thickness of up to a thickness of 40 mm cannot be satisfied. Furthermore, even with a plate thickness of 15 mm, there are the problems that the content of C is small, the microstructure of the joint becomes coarse grained, and sufficient low temperature toughness of the joint cannot be obtained.

In the invention described in PLT 7, as described in the examples, addition of 1.0% or so of Ni is necessary, so the system of ingredients becomes expensive and there are problems in production costs. In the invention described in PLT 8, production is only possible up to the plate thickness 12 mm described in the examples. Demand for plate thicknesses of up to thicknesses of 40 mm cannot be satisfied. Furthermore, as a feature of its rolling conditions, in the dual phase temperature range of ferrite and austenite, the rolling is performed by a cumulative reduction rate of 16 to 30%, so the ferrite grains easily become coarser. Even in production of a plate thickness of 12 mm, there is a problem in that the strength and toughness easily fall.

As explained above, high strength thick-gauge steel plate of up to a plate thickness of 40 mm able to satisfy the requirements of high strength and high toughness of the base material and of high weldability while limiting the contents of expensive alloy elements of Ni, Mo, V, Cu, and Nb, preferably not adding them, and eliminating the reheat tempering heat treatment after rolling and cooling, and a method of production of the same, have yet to be invented despite the strong demand from users.

In thick-gauge steel plate with a base material tensile strength of the 780 MPa class, the effect of the plate thickness on the ability to realize a preheat-free process is extremely great. With less than a plate thickness of 12 mm, a preheat-free process can be easily achieved. This is because if the plate thickness is less than 12 mm, it is possible to increase the cooling rate of the steel plate at the time of water cooling to 100° C./sec or more even at the center part of plate thickness. In this case, it is possible to make the structure of the base material a martensite structure and to obtain a tensile strength 780 MPa class of strength of the base material with a smaller amount of addition of alloy elements. Since the amount of addition of alloy elements is small, it is possible to keep down the hardness of the weld heat affected zone even without preheating and possible to prevent weld cracking even by a preheat-free process.

On the other hand, if the plate thickness becomes greater, the cooling rate at the time of water cooling inevitably becomes smaller. For this reason, with the same ingredients as thin-gauge steel plate, the quenching becomes insufficient, so thick-gauge steel plate falls in strength and the requirement of a 780 MPa class tensile strength can no longer be satisfied. In particular, the drop in strength is remarkable at the center part of plate thickness (½t part) where the cooling rate becomes the smallest. With thick-gauge steel plate with a plate thickness of over 40 mm where the cooling rate becomes lower than 8° C./sec, large addition of alloy elements becomes essential for securing the strength of the base material and achieving a welding preheat-free process becomes extremely difficult.

Therefore, the present invention has as its object the provision of high strength steel plate able to satisfy the requirements of high strength and high toughness of the base material and of high weldability while limiting the contents of expensive alloy elements of Ni, Mo, V, Cu, and Nb, preferably not adding them, and eliminating the reheat tempering heat treatment after rolling and cooling, and a method of production of the same. Specifically, it provides high strength thick-gauge steel plate superior in weldability and having a tensile strength of 780 MPa or more which has, at the center part of plate thickness of the base material, a tensile strength 780 MPa or more, preferably 1000 MPa or less, and a yield stress of 685 MPa or more, has a −20° C. Charpy absorption energy of 100J or more, and satisfies the requirement of the preheating temperature required at the time of a JIS Z 3158 "y-groove weld cracking test" at room temperature being 25° C. or less, and a method of production of the same. Therefore, the plate thickness of the steel plate covered by the present invention is 12 mm to 40 mm.

Solution to Problem

To solve the above problem, the inventors engaged in numerous studies on base materials and weld joints assuming production by rolling, then direct quenching of systems of ingredients not having Ni, Mo, V, Cu, or Nb added. Among these, for systems of ingredients not having Ni, Mo, V, Cu, or Nb added but having B added, they engaged in studies relating to the added ingredients for realization of a preheat-free process at the time of small heat input welding. As a result, they learned that it becomes possible to achieve a preheat-free process by restricting the amount of addition of C and the weld cracking sensitivity parameter able to be evaluated as the Pcm value. Specifically, they learned that by strictly restricting the amount of addition of C to 0.055% or less and restricting the Pcm value to 0.24% or less, it is possible to make the preheating temperature required at the time of a JIS Z 3158 "y-groove weld cracking test" at room temperature 25° C. or less.

However, the inventors proceeded with further studies and as a result learned that assuming a Pcm value of 0.24% or less and a low amount of C of 0.055% or less, it is extremely difficult to achieve both strength and toughness of the base material across the entire thickness in the plate thickness direction up to a plate thickness of 40 mm while restricting the contents of Ni, Mo, V, Cu, and Nb effective for improving strength and toughness, preferably while not adding them.

As opposed to this, the inventors engaged in numerous detailed studies on the amounts of addition of Mn, S, Al, N, and Ti in boron steel and, furthermore, the heating, rolling, and cooling conditions. As a result, they newly discovered that by making the amount of addition of Mn a large amount of 2.4% or more, strictly limiting S 0.0010% or less, and adding Al in 0.06% or more and by making N 0.0015% to 0.0060%, furthermore not adding Ti, making the heating temperature 950° C. to 1100° C., rolling at 820° C. or more, then immediately water cooling from 700° C. or more to room temperature to 350° C. by a cooling rate of 8° C./sec to 80° C./sec, it is first possible to achieve both strength and toughness of the base material across the entire thickness in the plate thickness direction up to a thickness of 40 mm, specifically, to satisfy the requirements of a tensile strength of 780 MPa or more, a yield stress of 685 MPa or more, and a −20° C. Charpy absorption energy of 100J or more.

The present invention was made based on the above new discovery and has as its gist the following:

(1) High strength thick-gauge steel plate superior in weldability and having a tensile strength of 780 MPa or more characterized by containing, by mass %, C: 0.030% or more, 0.055% or less, Mn: 2.4% or more, 3.5% or less, P: 0.01% or less, S: 0.0010% or less, Al: 0.06% or more, 0.10% or less, B: 0.0005% or more, 0.0020% or less, N: 0.0015% or more, and 0.0060% or less, limiting Ti to 0.004% or less, having a weld cracking susceptibility parameter Pcm shown by the following of 0.18% to 0.24%, and having a balance of Fe and unavoidable impurities as its composition of ingredients and having a microstructure of the steel comprised of martensite and of a balance, by an area fraction of 3% or less, of one or more of ferrite, bainite, and cementite:

$$Pcm=[C]+[Si]/30+[Mn]/20+[Cu]/20+[Ni]/60+[Cr]/20+[Mo]/15+[V]/10+5[B]$$

where, [C], [Si], [Mn], [Cu], [Ni], [Cr], [Mo], [V], and [B] respectively mean contents of C, Si, Mn, Cu, Ni, Cr, Mo, V, and B expressed by mass %.

(2) High strength thick-gauge steel plate superior in weldability and having a tensile strength of 780 MPa or more as set forth in the above (1) characterized by further containing, by mass %, one or more of Cu: over 0.05%, 0.50% or less, Ni: over 0.03%, 0.50% or less, Mo: over 0.03%, 0.30% or less, Nb: over 0.003%, 0.05% or less, V: over 0.005% to 0.07%.

(3) High strength thick-gauge steel plate superior in weldability and having a tensile strength of 780 MPa or more as set forth in the above (1) or (2) characterized by further containing, by mass %, one or more of Si: 0.05% to 0.40% and Cr: 0.10% to 1.5%.

(4) High strength thick-gauge steel plate superior in weldability and having a tensile strength of 780 MPa or more as set forth in any one of the above (1) to (3) characterized by further containing, by mass %, one or more of Mg: 0.0005% to 0.01% and Ca: 0.0005% to 0.01%.

(5) High strength thick-gauge steel plate superior in weldability and having a tensile strength of 780 MPa or more as set forth in any one of the above (1) to (5) characterized by having a plate thickness of 12 mm to 40 mm.

(6) A method of production of high strength thick-gauge steel plate superior in weldability and having tensile strength of 780 MPa or more comprising a method of production of high strength thick-gauge steel plate as set forth in any one of the above (1) to (5) characterized by heating a steel slab or cast slab having a composition of ingredients as set forth in any of the above (1) to (4) to 950° C. to 1100° C., rolling at 820° C. or more, then starting accelerated cooling from 700° C. or more by a cooling rate of 8° C./sec to 80° C./sec and stopping the accelerated cooling at room temperature to 350° C.

Note that, the high strength thick-gauge steel plate of the present invention sometimes contains Si used as a deoxidizing agent, Cu, Ni, Cr, Mo, Nb, or V included in the scrap or other raw materials, and Mg, Ca, etc. included in the refractories etc. Even if these are contained in fine amounts, they will not have any particular effect and also will not impair the properties. Therefore, inclusion of Si: less than 0.05%, Cu: 0.05% or less, Ni: 0.03% or less, Cr: less than 0.10%, Mo: 0.03% or less, Nb: 0.003% or less, V: 0.005% or less, Mg: less than 0.0005%, and Ca: less than 0.0005% is allowed.

Advantageous Effects of Invention

According to the present invention, it is possible to produce high strength thick-gauge steel plate superior in preheat-free weldability, having a tensile strength of 780 MPa or more, and having a plate thickness of 12 mm to 40 mm suitable as a structural member for welded structures for which there is a strong need for higher strength such as construction machines, industrial machinery, bridges, buildings, and ships without using expensive Ni, Mo, V, Cu, and Nb and without requiring reheat tempering heat treatment after rolling and thereby by a high productivity and at a low cost. The effect on the industry is extremely great.

DESCRIPTION OF EMBODIMENTS

Below, the reasons for limitation of the compositions of ingredients, microstructures, rolling conditions, and other aspects of the method of production of the steel plate in the present invention will be explained.

C has to be added in 0.030% or more to satisfy the base material strength. To make the base material strength higher, the lower limit of C may be set at 0.035% or 0.040% as well.

If the amount of addition exceeds 0.055%, the preheating temperature required at the time of welding exceeds 25° C. and a preheat-free process cannot be realized, so the upper limit value is made 0.055%. To further improve the weldability, the upper limit of C may be set at 0.050% as well.

Mn has to be added in 2.4% or more to achieve both strength and toughness of the base material. More preferably, the lower limit of Mn may be set to 2.55%, 2.65%, or 2.75%. If added over 3.5%, coarse MnS harmful to toughness is formed at the center segregated part of the steel slab or cast slab and the toughness of the base material at the center part of plate thickness falls, so the upper limit is made 3.5%. To stabilize the toughness of the base material at the center segregated part, the upper limit of Mn may also be set to 3.30%, 3.10%, or 3.00%.

Al, in addition to its role as a deoxidizing element, has the important role of forming AlN with N at the time of heating and rolling so as to suppress the formation of BN, control the B to a solid solution state at the time of cooling, and raise the hardenability of the steel. If making the amount of addition of Mn 2.4% or more, then strictly controlling the amount of Al and amount of N, N will precipitate as AlN at the time of heating before rolling and at the time of rolling, so the N for forming the BN will become smaller and the amount of solid solution boron required for raising the hardenability can be secured. To form AlN at the time of heating and rolling, Al has to be added in an amount of 0.06% or more. If added over 0.10%, coarse alumina inclusions are formed and the toughness is reduced in some cases, so the upper limit is made 0.10%. To prevent the formation of coarse alumina inclusions, the upper limit of Al may be set to 0.08%. Note that, if the amount of addition of Mn falls below 2.4%, AlN will be hard to precipitate at the time of heating and rolling, the amount of boron in solid solution will be reduced, and the hardenability will fall, so in addition to controlling the amount of Al and the amount of N, it is necessary to add 2.4% or more of Mn.

N precipitates as AlN at the time of heating and makes the γ-grain size finer to thereby improve the toughness.

In the invention steel limited in contents of expensive Nb and Ti harmful to toughness and preferably not containing Nb or Ti, the effect of refinement of the γ-grain size by NbC or TiN is insufficient or else cannot be utilized. For this reason, in the invention steel, the effect of refinement of the γ-grain size by AlN is essential for improvement of the toughness. To obtain this effect, addition of 0.0015% or more of N is necessary. If adding over 0.0060%, boron is caused to precipitate as BN and the amount of solid solution boron is reduced resulting in a drop in hardenability, so the upper limit is made 0.0060%.

P causes the base material and joint to drop in low temperature toughness, so is preferably not included. The allowable value as an impurity element unavoidably included in the steel is 0.01% or less. To improve the low temperature toughness of the base material and joint, P may be limited to 0.008% or less.

S forms coarse MnS and lowers the toughness of the base material and joint in the present invention where a large amount of Mn is added, so preferably is not included. Furthermore, in the present invention, the contents of the expensive Ni, Mo, V, Cu, and Nb effective for achieving both high strength and high toughness are restricted or these elements are not used, so the coarse MnS is extremely harmful. The allowable value as an impurity element unavoidably entering the steel is 0.0010% or less. Strict control is required. To improve the low temperature toughness of the base material and joint, S may be restricted to 0.0008% or less, 0.0006% or less, or 0.0004% or less.

B has to be added in 0.0005% or more to improve the hardenability and obtain a high strength and high toughness of the base material. If added over 0.0020%, the hardenability falls and a good low temperature toughness of the joint or sufficient high strength and high toughness of the base material cannot be obtained in some cases, so the upper limit was made 0.0020%. The upper limit of B may be set to 0.0015%.

Ti forms brittle phase TiN particles in the base material and joint which act as starting points of embrittlement fracture and greatly lower the toughness in high strength steel like in the present invention, so is harmful. In particular, in steel like the present invention where the expensive Ni, Mo, V, Cu, and Nb effective for achieving both high strength and high toughness are restricted in content and preferably are not used, TiN is very harmful. For this reason, it is necessary that Ti not be added. The allowable value as an impurity element unavoidably entering the steel is 0.004% or less.

In the present invention, Ni, Mo, V, Cu, and Nb are preferably not added. When Ni, Mo, V, Cu, and Nb unavoidably enter from the raw materials etc., even if included, the cost does not become higher. The upper limit values of the Ni, Mo, V, Cu, and Nb unavoidably entering the steel are Ni, Mo: 0.03% or less, V: 0.005% or less, Cu: 0.05% or less, Nb: 0.003% or less.

However, due to the addition of Ni, Mo, V, Cu, and Nb, the hardenability is improved or carbonitrides are formed. For this reason, to improve the strength and toughness of the base material, it is also possible to add one or more of Ni, Mo, V, Cu, and Nb. In this case, in the present invention, Ni, Mo, V, Cu, and Nb are deliberately added over the ranges of unavoidable impurities in a range where the costs are not increased. The upper limits of the amounts of addition are, specifically, Cu, Ni: 0.50% or less, Mo: 0.30% or less, Nb: 0.05% or less, and V: 0.07% or less. Furthermore, from the viewpoint of the costs, it is preferable to make the upper limits Cu, Ni: 0.30% or less, Mo: 0.10% or less, Nb: 0.02% or less, and V: 0.03% or less.

Further, in the present invention, in accordance with need, one or both of Si and Cr may be further added.

Si is a deoxidizing element. It does not necessarily have to be included, but addition of 0.05% or more is preferable. Further, it may also be added to secure the strength of the base material. To obtain this effect, addition of 0.10% or more is preferable. However, if added in over 0.40%, the base material and joint fall in toughness, so the upper limit is made 0.40%. Note that, in the present invention, when the content of Si is less than 0.05%, the element does not contribute to the rise of the strength or the reduction of the toughness, so is deemed to be an unavoidable impurity.

Cr may also be added to secure the strength of the base material. To obtain this effect, addition of 0.10% or more is necessary. However, if adding over 1.5%, the base material and joint fall in toughness, so the upper limit is set at 1.5%. To avoid an increase in cost due to addition of Cr, it is also possible to limit the Cr to 1.0% or less, 0.6% or less, or 0.4% or less. Note that, in the present invention, if the content of Cr entering from the raw materials is less than 0.10%, this will not contribute to the rise of the strength or reduction of the toughness, so the element is deemed an unavoidable impurity.

Further, in the present invention, by further adding one or both of Mg and Ca in accordance with need, it is possible to form fine sulfides or oxides and raise the toughness of the base material and toughness of the joint. To obtain this effect, Mg or Ca has to be added in an amount of 0.0005% or more. However, if added excessively over 0.01%, coarse sulfides and oxides are formed, so conversely the toughness is sometimes reduced. Therefore, the amounts of addition are made respectively 0.0005% or more and 0.01% or less. Note that, in the present invention, if the contents of the Mg and Ca entering from refractories etc. are less than 0.0005%, these elements do not contribute to the improvement and reduction of toughness, so are deemed unavoidable impurities.

In the present invention, if the weld cracking susceptibility parameter Pcm is not made 0.24% or less, preheating at the time of welding cannot be eliminated. Therefore, the upper limit of the Pcm value is made 0.24% or less. To improve the weldability, the upper limit may also be set at 0.23% or 0.22%. If the Pcm value becomes less than 0.18%, the high strength and high toughness requirements of the base material cannot be satisfied, so the lower limit is made 0.18%.

Here, $Pcm=[C]+[Si]/30+[Mn]/20+[Cu]/20+[Ni]/60+[Cr]/20+[Mo]/15+[V]/10+5[B]$, where [C], [Si], [Mn], [Cu], [Ni], [Cr], [Mo], [V], and [B] respectively mean the contents of C, Si, Mn, Cu, Ni, Cr, Mo, V, and B expressed by mass %.

Next, the microstructure of the steel plate of the present invention will be explained.

In order for steel plate to have a predetermined strength and toughness, it is necessary that its microstructure be mainly martensite. The balance other than the martensite is comprised of one or more of ferrite, bainite, and cementite. The total area fraction of the latter has to be 3% or less.

This is because if the area fraction of the one or more structures of ferrite, bainite, and cementite totals over 3%, the tensile strength will sometimes not satisfy 780 MPa and, further, a high toughness cannot be obtained.

The area fraction of the microstructure is determined by Nital corrosion, followed by SEM observation. Cementite, ferrite, martensite, or bainite is judged from the black parts in the white and black portions of the image. Martensite and bainite are differentiated by the presence or absence of fine carbides. A microstructure with no carbides is judged to be martensite.

The martensite area fraction is mainly determined by the ingredients of the steel material (hardenability) and the austenite grain size before accelerated cooling and the cooling rate. Therefore, to make the area fraction of the martensite 97% or more, it is important to add suitable quantities of C, Mn, B, and other elements improving the hardenability.

Next, the method of production of the steel plate of the present invention will be explained.

The steel plate of the present invention is provided by smelting steel containing a composition as set forth in the above (1) or (2), casting it to obtain a steel slab or cast slab, and heating, rolling, and cooling this steel slab or cast slab under predetermined conditions.

The heating temperature of the steel slab or cast slab has to be the 950° C. or more required for rolling. If over 1100° C., the AlN forms a solid solution and the solid solution boron precipitates as BN during the rolling and cooling, so the hardenability falls, the area fraction of the martensite becomes smaller than 97%, and a high strength and high toughness cannot be obtained, so the upper limit is made 1100° C.

If the rolling temperature (rolling end temperature) falls below 820° C., the excessive accumulation of rolling strain causes the formation of local ferrite structures and coarse bainite structures including island shaped martensite, the area fraction of martensite becomes smaller than 97%, and high strength and high toughness of the base material cannot be obtained in some cases, so the lower limit of the rolling temperature is set as 820° C.

When the start temperature of the accelerated cooling after rolling is less than 700° C., local ferrite structures and coarse bainite structures containing island shaped martensite are produced, the area fraction of martensite becomes smaller than 97%, and high strength and high toughness of the base material are not obtained, so the lower limit temperature of the start temperature of the accelerated cooling is made 700° C.

When the accelerated cooling has a cooling rate of less than 8° C./sec, local ferrite structures and coarse bainite structures containing island shaped martensite are produced, the area fraction of martensite becomes smaller than 97%, and high strength and high toughness of the base material are not obtained, so the lower limit value is made 8° C./sec. The upper limit is made the cooling rate which can be stably realized by water cooling, that is, 80° C./sec.

Further, if the stop temperature of the accelerated cooling is higher than 350° C., in particular, at the center part of plate thickness of thick-gauge material of a plate thickness of 30 mm or more, insufficient quenching results in formation of local ferrite structures or coarse bainite structures including island shaped martensite. The area fraction of martensite becomes smaller than 97%, and a high strength of the base material cannot be obtained. Therefore, the upper limit of the stop temperature is made 350° C. The stop temperature at this time is made the surface temperature of the steel plate when the steel plate recovers after the end of cooling. The lower limit of the stop temperature is room temperature, but from the viewpoint of the dehydrogenation of the steel plate, the more preferable stop temperature is 100° C. or more.

EXAMPLES

Steels of the compositions of ingredients shown in Table 1 were smelted to obtain steel slabs which were then rolled under the production conditions shown in Table 2 to obtain 12 to 40 mm thick steel plates. A to K in Table 1 are invention examples, while L to Y are comparative examples. Further, 1 to 13 of Table 2 are invention examples, while 14 to 32 are comparative examples. In the tables, the underlined figures and notations are ones where the ingredients or production conditions are outside the scope of the patent or the properties do not satisfy the following target values. Note that, Table 1 shows the analysis values for all elements. Si: less than 0.05%, Cu: 0.05% or less, Ni: 0.03% or less, Cr: less than 0.10%, Mo: 0.03% or less, Nb: 0.003% or less, V: 0.005% or less, Mg: less than 0.0005%, Ca: less than 0.0005% and not 0% are contents as unavoidable impurities.

Note that, Si, Cu, Ni, Cr, Mo, Nb, V, Mg, and Ca are unavoidable impurities derived from the deoxidizing agents, raw materials, refractories, etc. The ones not affecting the strength and toughness are shown by italics in Table 1.

TABLE 1

| | Steel material | Chemical composition (mass %) C | Mn | P | S | Al | B | N | Ti | Cu |
|---|---|---|---|---|---|---|---|---|---|---|
| Inv. steel | A | 0.037 | 2.74 | 0.009 | 0.0005 | 0.068 | 0.0006 | 0.0024 | 0 | 0 |
| | B | 0.048 | 2.98 | 0.007 | 0.0010 | 0.068 | 0.0017 | 0.0042 | *0.004* | *0.04* |
| | C | 0.044 | 2.57 | 0.007 | 0.0006 | 0.060 | 0.0020 | 0.0015 | *0.002* | *0.02* |
| | D | 0.030 | 2.40 | 0.005 | 0.0007 | 0.075 | 0.0005 | 0.0047 | 0 | 0 |
| | E | 0.055 | 3.50 | 0.003 | 0.0009 | 0.100 | 0.0010 | 0.0042 | *0.001* | *0.04* |
| | F | 0.055 | 2.76 | 0.006 | 0.0004 | 0.082 | 0.0007 | 0.0060 | 0 | 0 |
| | G | 0.048 | 2.55 | 0.008 | 0.0005 | 0.071 | 0.0008 | 0.0033 | 0 | 0.31 |
| | H | 0.042 | 2.41 | 0.009 | 0.0005 | 0.065 | 0.0012 | 0.0036 | 0 | *0.03* |
| | I | 0.053 | 2.43 | 0.008 | 0.0006 | 0.063 | 0.0011 | 0.0028 | *0.001* | *0.02* |
| | J | 0.051 | 2.96 | 0.008 | 0.0007 | 0.063 | 0.0009 | 0.0028 | 0 | *0.03* |
| | K | 0.056 | 2.94 | 0.007 | 0.0006 | 0.067 | 0.0008 | 0.0040 | 0 | *0.01* |
| Comp. steel | L | 0.025 | 3.12 | 0.008 | 0.0010 | 0.075 | 0.0015 | 0.0025 | *0.001* | *0.01* |
| | M | 0.060 | 3.34 | 0.009 | 0.0010 | 0.072 | 0.0013 | 0.0035 | *0.002* | *0.01* |
| | N | 0.053 | 2.35 | 0.008 | 0.0008 | 0.063 | 0.0015 | 0.0057 | *0.003* | *0.02* |
| | O | 0.043 | 3.63 | 0.007 | 0.0010 | 0.067 | 0.0006 | 0.0036 | *0.001* | 0 |
| | P | 0.048 | 2.68 | 0.009 | 0.0015 | 0.095 | 0.0020 | 0.0029 | *0.002* | *0.03* |
| | Q | 0.045 | 2.96 | 0.008 | 0.0008 | 0.062 | 0.0013 | 0.0055 | 0.014 | *0.01* |
| | R | 0.052 | 2.45 | 0.010 | 0.0010 | 0.052 | 0.0009 | 0.0027 | 0 | *0.02* |
| | S | 0.055 | 2.63 | 0.005 | 0.0008 | 0.060 | 0.0010 | 0.0065 | 0 | *0.02* |
| | T | 0.052 | 3.42 | 0.006 | 0.0009 | 0.068 | 0.0015 | 0.0038 | *0.001* | *0.01* |
| | U | 0.050 | 2.75 | 0.007 | 0.0007 | 0.105 | 0.0012 | 0.0038 | 0 | *0.01* |
| | V | 0.053 | 2.55 | 0.008 | 0.0008 | 0.062 | 0.0021 | 0.0045 | 0 | *0.01* |
| | W | 0.052 | 3.11 | 0.008 | 0.0008 | 0.065 | 0.0004 | 0.0042 | 0 | *0.01* |
| | X | 0.051 | 2.89 | 0.007 | 0.0009 | 0.064 | 0.0009 | 0.0013 | 0 | *0.01* |
| | Y | 0.048 | 2.50 | 0.012 | 0.0008 | 0.062 | 0.0011 | 0.0042 | 0 | *0.01* |

| | Steel material | Chemical composition (mass %) Ni | Mo | Nb | V | Si | Cr | Mg | Ca | Index Pcm* |
|---|---|---|---|---|---|---|---|---|---|---|
| Inv. steel | A | 0 | 0 | 0 | 0 | 0.06 | *0.02* | 0 | 0 | 0.180 |
| | B | *0.02* | *0.01* | *0.001* | *0.001* | 0.08 | *0.03* | *0.0001* | *0.0001* | 0.213 |
| | C | *0.03* | 0 | *0.001* | *0.001* | 0.40 | *0.05* | *0.0002* | 0.0015 | 0.200 |
| | D | 0 | 0 | 0 | 0 | 0.05 | 1.48 | 0.0025 | 0 | 0.228 |
| | E | *0.02* | *0.01* | *0.001* | *0.001* | *0.02* | *0.03* | *0.0001* | *0.0001* | 0.240 |
| | F | 0 | 0 | 0 | 0 | 0.31 | 0.43 | *0.0022* | *0.0023* | 0.228 |
| | G | *0.02* | 0 | 0 | 0 | 0.10 | *0.03* | 0 | 0 | 0.200 |
| | H | 0.48 | 0 | *0.001* | 0 | 0.09 | 0 | 0 | 0 | 0.181 |
| | I | *0.01* | 0.21 | 0 | 0 | 0.07 | *0.02* | 0 | 0 | 0.199 |
| | J | *0.02* | *0.01* | 0.018 | 0 | 0.20 | *0.01* | 0 | 0 | 0.213 |
| | K | 0 | 0 | 0 | 0.042 | 0.23 | 0 | 0 | 0 | 0.219 |
| Comp. steel | L | 0 | *0.01* | 0 | *0.001* | 0.06 | *0.01* | *0.0001* | *0.0001* | 0.192 |
| | M | 0 | 0 | *0.001* | *0.002* | 0.07 | *0.01* | 0 | 0 | 0.237 |
| | N | *0.01* | *0.02* | *0.001* | *0.001* | *0.04* | *0.03* | 0 | 0 | 0.183 |
| | O | *0.01* | *0.01* | *0.002* | 0 | 0.05 | *0.04* | 0 | 0 | 0.232 |
| | P | 0 | *0.03* | 0 | 0 | 0.06 | *0.02* | 0 | 0.0014 | 0.199 |
| | Q | 0 | 0 | 0 | 0 | 0.15 | *0.01* | 0 | 0 | 0.206 |
| | R | *0.01* | 0 | *0.003* | 0 | 0.07 | 0.25 | *0.0002* | *0.0002* | 0.195 |
| | S | *0.02* | 0 | 0 | *0.005* | 0.06 | *0.03* | *0.0003* | *0.0000* | 0.197 |
| | T | *0.02* | 0 | 0 | 0 | 0.38 | 0.27 | *0.0001* | *0.0001* | 0.258 |
| | U | *0.01* | 0 | 0 | 0 | 0.25 | *0.01* | 0 | 0 | 0.203 |
| | V | *0.01* | 0 | 0 | 0 | 0.30 | *0.02* | 0 | 0 | 0.203 |
| | W | *0.01* | 0 | 0 | 0 | 0.35 | *0.01* | 0 | 0 | 0.222 |
| | X | *0.01* | 0 | 0 | 0 | 0.22 | *0.02* | 0 | 0 | 0.209 |
| | Y | *0.02* | 0 | 0 | 0 | 0.07 | *0.01* | 0 | 0 | 0.182 |

*Pcm = C + Si/30 + Mn/20 + Cu/20 + Ni/60 + Cr/20 + Mo/15 + V/10 + 5B

Underlines show outside scope of present invention.

Italics in Si, Cu, Ni, Cr, Mo, Nb, V, Ti, Mg, and Ca mean contents not affecting strength and toughness.

TABLE 2

| | Prod. cond. no. | Steel mat. | Heating temp. at rolling (° C.) | Slab thick. (mm) | Rolling end temp. (° C.) | Cooling start temp. (° C.) | Cooling speed (° C./sec) | Cooling stop temp. (° C.) | Plate thick. (mm) | Microstructure: Martensite fraction (%) | Microstructure: Ferrite, bainite, cementite fraction total (%) |
|---|---|---|---|---|---|---|---|---|---|---|---|
| Inv. ex. | 1 | E | 950 | 240 | 820 | 770 | 15 | 25 | 40 | 100 | 0 |
| | 2 | E | 1020 | 240 | 850 | 800 | 8 | 350 | 40 | 97 | 3 |
| | 3 | B | 1050 | 240 | 840 | 770 | 18 | 320 | 30 | 99 | 1 |
| | 4 | B | 1100 | 240 | 880 | 820 | 18 | 220 | 30 | 100 | 0 |
| | 5 | F | 1000 | 240 | 840 | 800 | 14 | 25 | 30 | 100 | 0 |
| | 6 | C | 980 | 230 | 840 | 750 | 20 | 260 | 25 | 99 | 1 |
| | 7 | D | 1080 | 230 | 820 | 720 | 25 | 340 | 20 | 100 | 0 |
| | 8 | A | 1090 | 140 | 830 | 700 | 80 | 350 | 12 | 100 | 0 |
| | 9 | G | 1020 | 240 | 840 | 790 | 25 | 25 | 20 | 100 | 0 |
| | 10 | H | 1050 | 240 | 830 | 780 | 25 | 25 | 20 | 100 | 0 |
| | 11 | I | 1060 | 240 | 840 | 785 | 25 | 25 | 20 | 98 | 2 |
| | 12 | J | 1100 | 240 | 850 | 820 | 70 | 25 | 12 | 100 | 0 |
| | 13 | K | 1100 | 240 | 840 | 815 | 70 | 25 | 12 | 97 | 3 |
| Comp. ex. | 14 | L | 1090 | 240 | 880 | 820 | 15 | 330 | 30 | 90 | 10 |
| | 15 | M | 1050 | 240 | 870 | 810 | 20 | 342 | 30 | 100 | 0 |
| | 16 | N | 1080 | 240 | 880 | 820 | 16 | 25 | 30 | 92 | 8 |
| | 17 | O | 1060 | 240 | 870 | 800 | 18 | 295 | 30 | 95 | 5 |
| | 18 | P | 1050 | 240 | 850 | 774 | 17 | 262 | 30 | 95 | 5 |
| | 19 | Q | 1070 | 240 | 860 | 795 | 17 | 286 | 30 | 93 | 7 |
| | 20 | R | 1080 | 240 | 830 | 720 | 18 | 150 | 30 | 90 | 10 |
| | 21 | S | 1100 | 240 | 830 | 710 | 20 | 230 | 30 | 95 | 5 |
| | 22 | T | 1070 | 240 | 840 | 780 | 20 | 200 | 30 | 100 | 0 |
| | 23 | U | 1070 | 240 | 830 | 810 | 17 | 240 | 30 | 96 | 4 |
| | 24 | V | 1100 | 240 | 840 | 785 | 16 | 310 | 30 | 95 | 5 |
| | 25 | W | 1050 | 240 | 850 | 820 | 17 | 280 | 30 | 92 | 8 |
| | 26 | X | 1080 | 240 | 840 | 815 | 20 | 280 | 30 | 95 | 5 |
| | 27 | Y | 950 | 240 | 830 | 780 | 15 | 25 | 40 | 100 | 0 |
| | 28 | A | 1130 | 240 | 880 | 820 | 14 | 320 | 40 | 96 | 4 |
| | 29 | A | 1080 | 240 | 810 | 750 | 18 | 240 | 30 | 88 | 12 |
| | 30 | C | 1090 | 140 | 820 | 690 | 70 | 25 | 12 | 94 | 6 |
| | 31 | C | 1060 | 230 | 840 | 740 | 19 | 420 | 20 | 93 | 7 |
| | 32 | B | 1050 | 240 | 840 | 770 | 7 | 300 | 30 | 89 | 11 |

| | Prod. cond. no. | Base material yield stress (MPa) ¼t | Base material yield stress (MPa) ½t | Base material tensile strength (MPa) ¼t | Base material tensile strength (MPa) ½t | Base material tough. vE-20 (J) | Required preheat. temp. (° C.) |
|---|---|---|---|---|---|---|---|
| Inv. ex. | 1 | 742 | 715 | 922 | 899 | 253 | 25 |
| | 2 | 753 | 722 | 889 | 860 | 226 | 25 |
| | 3 | 732 | 725 | 871 | 877 | 215 | No preheat. |
| | 4 | 722 | 703 | 886 | 879 | 208 | No preheat. |
| | 5 | 725 | 708 | 900 | 892 | 262 | No preheat. |
| | 6 | 746 | 735 | 910 | 905 | 293 | No preheat. |
| | 7 | 730 | | 875 | | 275 | No preheat. |
| | 8 | 700 | | 895 | | 308 | No preheat. |
| | 9 | 700 | | 879 | | 256 | No preheat. |
| | 10 | 731 | | 903 | | 271 | No preheat. |
| | 11 | 713 | | 896 | | 223 | No preheat. |
| | 12 | 694 | | 877 | | 248 | No preheat. |
| | 13 | 702 | | 892 | | 230 | No preheat. |
| Comp. ex. | 14 | 605 | 587 | 750 | 732 | 356 | No preheat. |
| | 15 | 741 | 730 | 893 | 889 | 153 | 50 |
| | 16 | 634 | 610 | 770 | 749 | 190 | No preheat. |
| | 17 | 735 | 724 | 893 | 889 | 72 | 25 |
| | 18 | 736 | 705 | 914 | 890 | 76 | No preheat. |
| | 19 | 724 | 700 | 899 | 873 | 60 | No preheat. |
| | 20 | 609 | 578 | 798 | 771 | 154 | No preheat. |
| | 21 | 645 | 622 | 845 | 827 | 125 | No preheat. |
| | 22 | 734 | 723 | 926 | 922 | 184 | 50 |
| | 23 | 710 | 695 | 797 | 786 | 96 | No preheat. |
| | 24 | 681 | 669 | 776 | 761 | 105 | No preheat. |
| | 25 | 657 | 633 | 761 | 745 | 123 | No preheat. |
| | 26 | 698 | 686 | 790 | 783 | 93 | No preheat. |
| | 27 | 735 | 726 | 885 | 869 | 89 | No preheat. |
| | 28 | 655 | 624 | 870 | 840 | 155 | No preheat. |

TABLE 2-continued

| | | | | | | |
|---|---|---|---|---|---|---|
| 29 | 571 | 567 | 748 | 752 | 205 | No preheat. |
| 30 | 643 | | 821 | | 204 | No preheat. |
| 31 | 623 | | 831 | | 56 | No preheat. |
| 32 | 670 | 664 | 772 | 763 | 95 | No preheat. |

The results of evaluation of these steel plates for the strength of the base material (yield stress of base material and tensile strength of base material) and toughness and weldability of the base material (required preheating temperature) are shown in Table 2.

The strength of the base material was measured using a No. 1β full thickness tensile test piece or No. 4 rod tensile test piece prescribed in JIS Z 2201 by the measurement method prescribed in JIS Z 2241. The tensile test piece used in the case of a plate thickness of 20 mm or less was a No. 1A full thickness tensile test piece and in the case of over 20 mm thickness a No. 4 rod tensile test piece taken from the ¼ part of plate thickness (¼t part) and center part of plate thickness (½t part).

The toughness of the base material was evaluated by obtaining an impact test piece prescribed in JIS Z 2202 from the center part of plate thickness in a direction perpendicular to the rolling direction and finding the −20° C. Charpy absorption energy (vE-20) by the method prescribed in JIS Z2242.

The weldability was evaluated at performing shield arc welding at 14 to 16° C. by the method prescribed in JIS Z 3158 with a heat input of 1.7 kJ/mm and finding the preheating temperature required for preventing root cracking.

The target values of the characteristics were made a yield stress of the base material of 685 MPa or more, a tensile strength of the base material of 780 MPa or more, a toughness (vE-20) of the base material of 100J or more, and a required preheating temperature of 25° C. or less.

Invention Examples 1 to 13 all had area rates of ferrite+bainite+cementite of 3% or less, yield stresses of the base material of 685 MPa or more, tensile strengths of the base material of 780 MPa or more, toughnesses (vE-20) of the base material of 100J or more, and required preheating temperatures of 25° C. or less.

As opposed to this, the following comparative examples were insufficient in yield stress and tensile strength of the base material. Comparative Example 14 had an amount of addition of C which is small, Comparative Example 16 had an amount of addition of Mn which is small, Comparative Example 20 had an amount of addition of Al which is small, Comparative Example 21 had an amount of addition of N which is large, Comparative Example 24 had an amount of addition of B which is large, Comparative Example 25 had an amount of addition of B which is small, Comparative Example 28 had a heating temperature which is high, Comparative Example 29 had a rolling end temperature under 820° C., Comparative Example 30 had a water cooling start temperature under 700° C., Comparative Example 31 had a cooling stop temperature over 350° C., and Comparative Example 32 had a cooling rate under 8° C./sec, so the area rate of ferrite+bainite+cementite exceeded 3% and the base material yield stress or tensile strength was insufficient.

Further, the following comparative examples were insufficient in base material toughness. Comparative Example 17 had an amount of addition of Mn which is large, Comparative Example 18 had an amount of addition of S which is large, Comparative Example 19 had Ti added, Comparative Example 23 had an amount of addition of Al which is large, and Comparative Example 26 had an amount of addition of N which is small, so the area rate of ferrite+bainite+cementite exceeded 3%. Further, Comparative Example 27 had an amount of addition of P which is large, so the yield stress and the tensile strength were satisfactory, but the toughness of the base material was insufficient. Further, Comparative Example 31 had a cooling stop temperature of over 350° C., so the toughness of the base material was also insufficient.

Comparative Example 15 had an amount of addition of C which is large, while Comparative Example 22 had a Pcm value which is high, so the required preheating temperature exceeded 25° C. and a preheat-free process could not be obtained.

The invention claimed is:

1. High strength thick-gauge steel plate superior in weldability and having a tensile strength of 780 MPa or more characterized by containing, by mass %, C: 0.030% or more, 0.055% or less, Mn: 2.55% or more, 3.5% or less, P: 0.01% or less, S: 0.0010% or less, Al: 0.06% or more, 0.10% or less, B: 0.0005% or more, 0.0020% or less, N: 0.0015% or more, and 0.0060% or less, limiting Ti to 0.004% or less, having a weld cracking susceptibility parameter Pcm shown by the following of 0.18% to 0.24%, and having a balance of Fe and unavoidable impurities as its composition of ingredients and having a microstructure of the steel comprised of martensite and of a balance, by an area fraction of 3% or less, of one or more of ferrite, bainite, and cementite:

Pcm=[C]+[Si]/30+[Mn]/20+[Cu]/20+[Ni]/60+[Cr]/20+[Mo]/15+[V]/10+5[B] where, [C], [Si], [Mn], [Cu], [Ni], [Cr], [Mo], [V], and [B] respectively mean contents of C, Si, Mn, Cu, Ni, Cr, Mo, V, and B expressed by mass %.

2. High strength thick-gauge steel plate superior in weldability and having a tensile strength of 780 MPa or more as set forth in claim 1 characterized by further containing, by mass %, one or more of Cu: over 0.05%, 0.50% or less, Ni: over 0.03%, 0.50% or less, Mo: over 0.03%, 0.30% or less, Nb: over 0.003%, 0.05% or less, V: over 0.005% to 0.07%.

3. High strength thick-gauge steel plate superior in weldability and having a tensile strength of 780 MPa or more as set forth in claim 1 or 2 characterized by further containing, by mass %, one or more of Si: 0.05% to 0.40% and Cr: 0.10% to 1.5%.

4. High strength thick-gauge steel plate superior in weldability and having a tensile strength of 780 MPa or more as set forth in claim 1 or 2 characterized by further containing, by mass %, one or more of Mg: 0.0005% to 0.01% and Ca: 0.0005% to 0.01%.

5. High strength thick-gauge steel plate superior in weldability and having a tensile strength of 780 MPa or more as set forth in claim 1 or 2 characterized by containing, by mass %, Mn: 2.65% or more, 3.5% or less.

6. High strength thick-gauge steel plate superior in weldability and having a tensile strength of 780 MPa or more as set forth in claim 1 or 2 characterized by containing, by mass %, Mn: 2.75% or more, 3.5% or less.

7. High strength thick-gauge steel plate superior in weldability and having a tensile strength of 780 MPa or more as set forth in claim 1 or 2 characterized by containing, by mass %, Al: 0.071% or more, 0.10% or less.

8. High strength thick-gauge steel plate superior in weldability and having a tensile strength of 780 MPa or more as set forth in claim 1 or 2 characterized by containing, by mass %, Al: 0.082% or more, 0.10% or less.

9. High strength thick-gauge steel plate superior in weldability and having a tensile strength of 780 MPa or more as set forth in claim 1 characterized by having a plate thickness of 12 mm to 40 mm.

10. A method of production of high strength thick-gauge steel plate superior in weldability and having tensile strength of 780 MPa or more comprising a method of production of high strength thick-gauge steel plate as set forth in claim 1 or 2 characterized by heating a steel slab or cast slab having a composition of ingredients as set forth in claim 1 or 2 to 950° C. to 1100° C., rolling at 820° C. or more, then starting accelerated cooling from 700° C. or more by a cooling rate of 8° C./sec to 80° C./sec and stopping the accelerated cooling at room temperature to 350° C.

* * * * *